US007715755B2

(12) United States Patent
Shiraki

(10) Patent No.: US 7,715,755 B2
(45) Date of Patent: May 11, 2010

(54) IMAGE FORMING APPARATUS AND DEVELOPING CARTRIDGE WITH DEFORMABLE HANDLE

(75) Inventor: Masatoshi Shiraki, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 304 days.

(21) Appl. No.: 11/687,247

(22) Filed: Mar. 16, 2007

(65) Prior Publication Data

US 2007/0217816 A1 Sep. 20, 2007

(30) Foreign Application Priority Data

Mar. 20, 2006 (JP) ..... 2006-077269

(51) Int. Cl.
*G03G 21/16* (2006.01)

(52) U.S. Cl. ..... 399/111; 399/108; 399/119; 399/113

(58) Field of Classification Search ..... 399/108, 399/111, 112, 113, 119
See application file for complete search history.

(56) References Cited

U.S. PATENT DOCUMENTS

| | | | | |
|---|---|---|---|---|
| 5,749,027 | A * | 5/1998 | Ikemoto et al. | 399/113 |
| 6,647,227 | B2 * | 11/2003 | Yokoi et al. | 399/111 |
| 6,708,011 | B2 | 3/2004 | Nomura et al. | |
| 2001/0055494 | A1 | 12/2001 | Katakabe | |
| 2004/0047657 | A1 | 3/2004 | Nagashima | |

FOREIGN PATENT DOCUMENTS

| | | | |
|---|---|---|---|
| JP | 60-229072 | A1 | 11/1985 |
| JP | 2003-015378 | A | 1/2003 |

OTHER PUBLICATIONS

Translation of Japanese Patent Pub. No. 2003-015378 to Katakabe.*
European Search Report dated Aug. 6, 2007 in Application No. EP 07 00 5625.

* cited by examiner

*Primary Examiner*—David M Gray
*Assistant Examiner*—Roy Yi
(74) *Attorney, Agent, or Firm*—Banner & Witcoff, Ltd

(57) ABSTRACT

A handle for a toner cartridge may include an opening and be constructed of elastically deformable materials. The handle may deform when inside of an image forming device to provide at least some force to press an image carrier against a developer carrier.

20 Claims, 13 Drawing Sheets

IMAGE FORMING APPARATUS AND DEVELOPING CARTRIDGE WITH DEFORMABLE HANDLE

CROSS REFERENCE TO RELATED APPLICATION

This application claims priority from Japanese Patent Application No. 2006-077269, filed on Mar. 20, 2006, the entire subject matter of which is incorporated herein by reference.

FIELD

Aspects of the invention relate to an image forming apparatus, such as a laser printer and a developing cartridge for use in the image forming apparatus.

BACKGROUND

A known tandem image forming apparatus is provided with image carriers corresponding to yellow, magenta, cyan and black toner. Such a tandem image forming apparatus can print in color at substantially the same speed as printing in monochrome, because a toner image of each color is formed at substantially the same time on each corresponding one of the image carriers and each of the different colored images is sequentially laid on top of a sheet while the sheet passes the image carriers.

As disclosed in one example of this type of tandem image forming apparatus, an image carrier cartridge supports image carriers, each associated with one color. The image carrier cartridge is slidably installed in or removed from a body casing of the image forming apparatus. A developing cartridge for developing an electrostatic latent image formed on each of the image carriers is removably set in the image carrier cartridge.

In one example of an image forming apparatus, four developing cartridges are installed in a frame of the image carrier cartridge with little space. Therefore, it is not easy to install in or remove the developing cartridges from the image carrier cartridge.

SUMMARY

Accordingly, one aspect of the invention is to provide an image forming apparatus in which a plurality of developing cartridges may be installed in or removed from an image carrier unit that is configured to hold the developing cartridges. Another aspect of the invention is to provide a developing cartridge that is easily installed into and/or removed from an image carrier unit that is configured to hold a plurality of the developing cartridges.

BRIEF DESCRIPTION OF THE DRAWINGS

One or more aspects of the invention will be described in detail with reference to the following figures in which like elements are labeled with like numbers and in which.

DETAILED DESCRIPTION

An illustrative embodiment of the invention will be described in detail below with reference to the accompanying drawings.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

Figure 1:
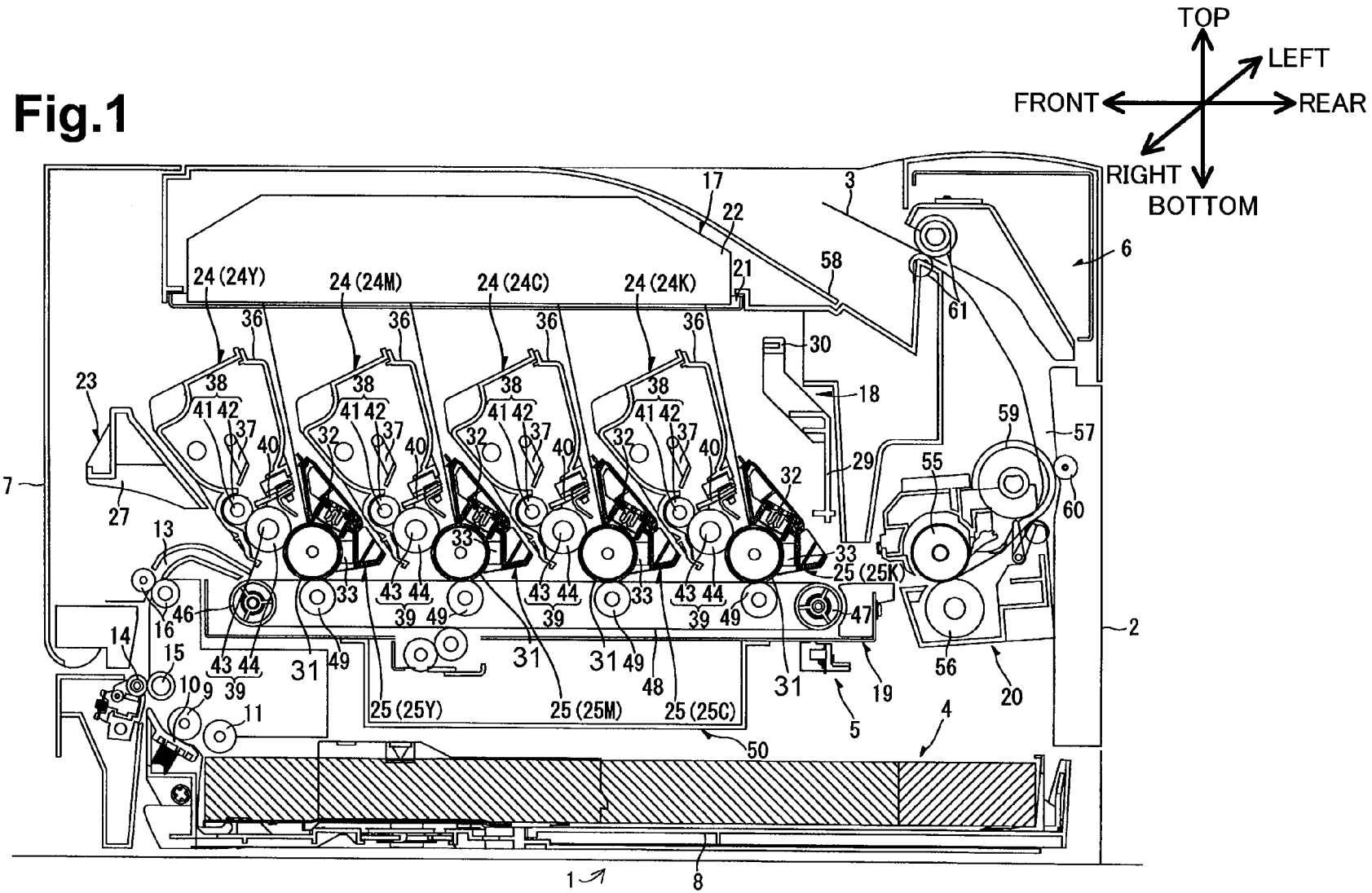
FIG. 1 is a sectional side view showing a general structure of a color laser printer as an image forming apparatus according to an embodiment of the invention.

As shown in FIG. 1, a color laser printer 1 is a tandem color laser printer in which a plurality of sub units 25 are arranged in tandem in a horizontal direction, as handling yellow, magenta, cyan and black toner.

The color laser printer 1 includes a body casing 2, a sheet supply section 4 that supplies a sheet 3, an image forming section 5 that forms an image on the sheet 3 fed therein, and a sheet ejection section 6 that ejects the sheet 3, where the image is formed on sheet 3. The sections 4, 5, 6 are disposed in the body casing 2.

In the following description, the left side in FIG. 1 is referred to as the front side of the printer 1, and an opposite side (the right side in FIG. 1) is referred to as the rear side of the printer 1, as shown by arrows in FIG. 1. The right and left sides of the printer 1 are defined when the printer 1 is viewed from the front side. Unless otherwise specified, the front, rear, left, right, top and bottom of a drum unit 23 and a developing cartridge 24 are defined in conjunction with an orientation in which the drum unit 23 and the developing cartridge 24 are installed in the body casing 2.

At the front wall of the body casing 2, a front cover 7 is disposed to cover or uncover a space in the body casing 2. The front cover 7 is pivotally supported about a lower end thereof by the front wall of the body casing 2. With the front cover 7 open, a process unit 18 can be withdrawn from the body casing 2 to a withdrawal position and inserted into an installation position.

Figure 6:
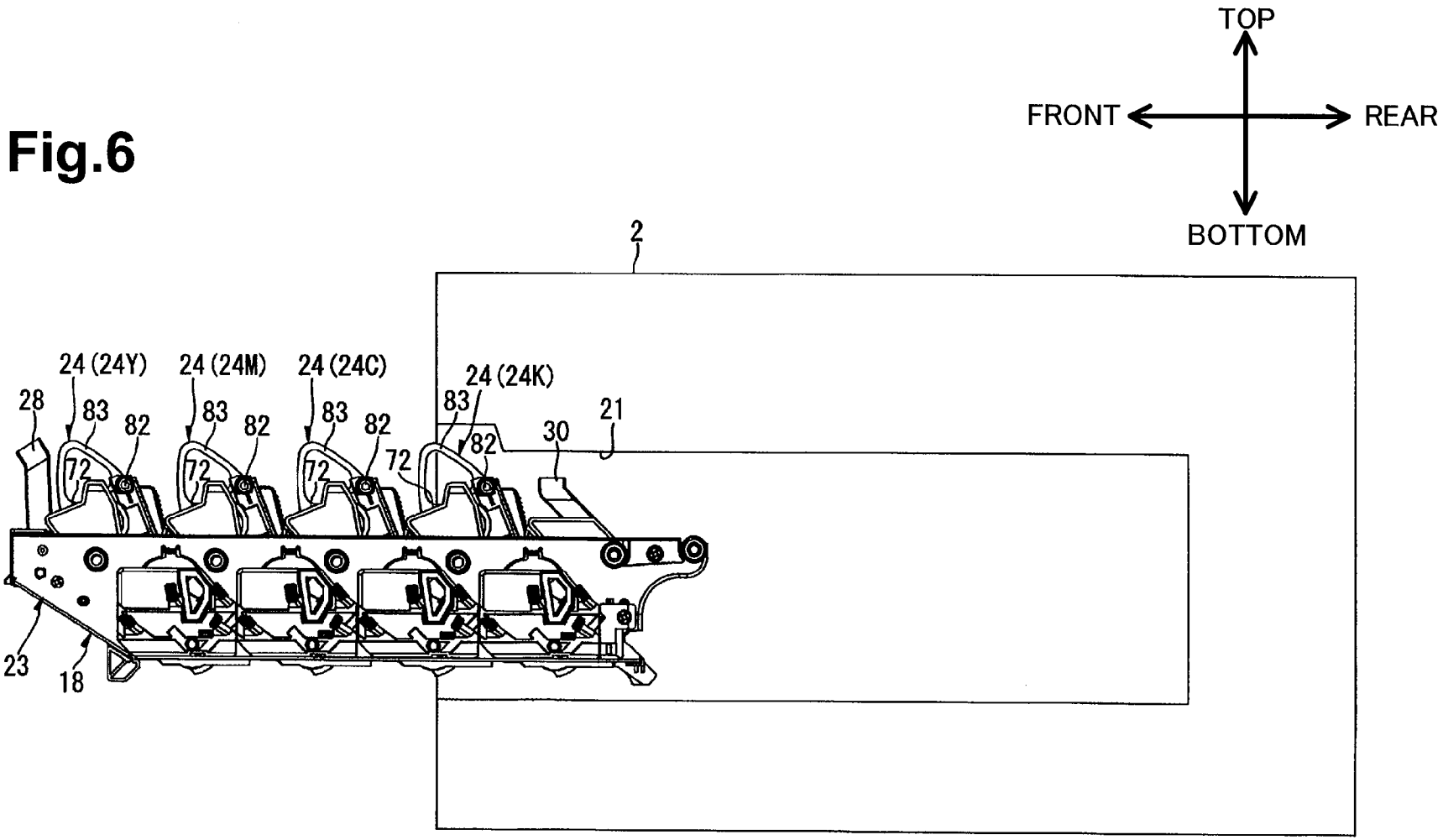
FIG. 6 is a right side view of a body casing of the printer and the process unit shown in FIG. 1, illustrating the process unit withdrawn from the body casing.
Figure 7:
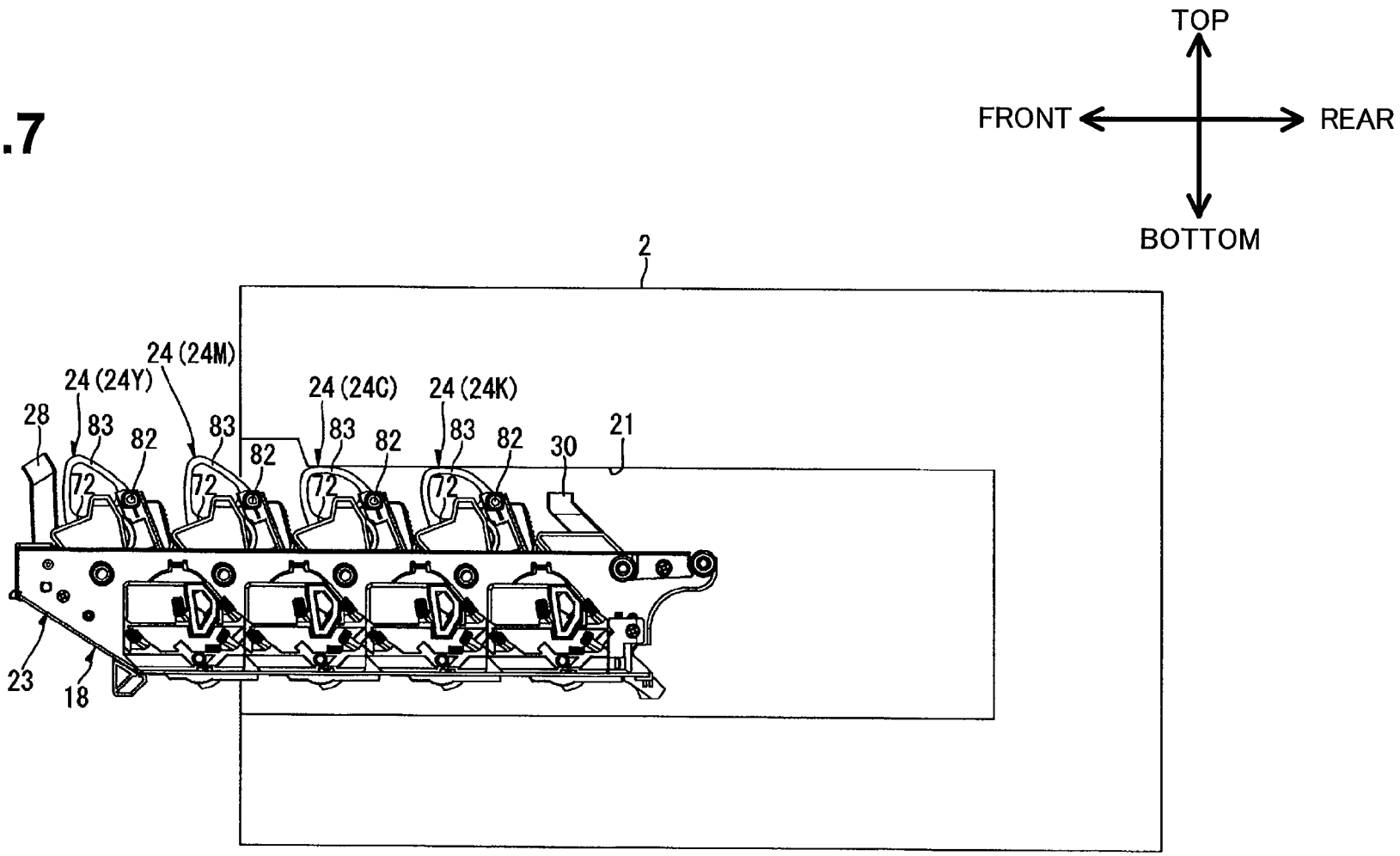
FIG. 7 is a right side view of the body casing of the printer and the process unit shown in FIG. 1, illustrating the process unit being inserted into the body casing.
Figure 8:
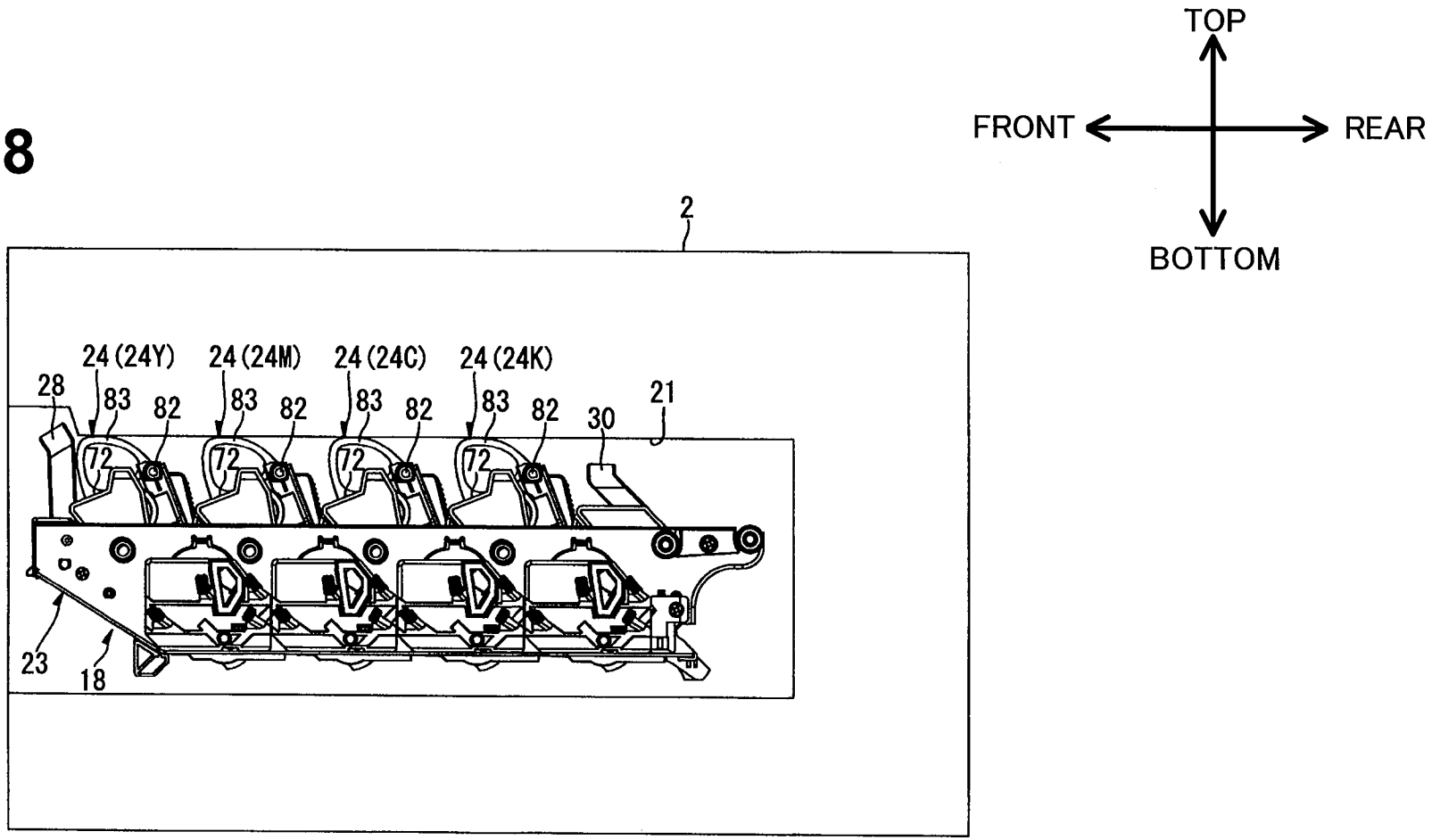
FIG. 8 is a right side view of the body casing of the printer and the process unit shown in FIG. 1, illustrating the process unit installed in the body casing.

As shown in FIGS. 1 and 8, the installation position refers to a position where the process unit 18 is placed during an image formation. As shown in FIGS. 6 and 7, the withdrawal position refers to a position where the process unit 18 is or is being withdrawn through the front cover 7. In the withdrawal position, the handles 83 of at least one of developing cartridges 24 are out of contact with a bottom surface of a supporting plate 21 of an exposure unit 17 (described below).

The sheet supply section 4 is provided at a bottom portion of the body casing 2. The sheet supply section 4 is inserted in or removed from the body casing 2 while being slid along the front-rear direction. The sheet supply section 4 includes a sheet supply tray 8, a separation roller 9, a separation pad 10, a pickup roller 11, and a sheet supply path 13. The sheet supply tray 8 holds sheets 3 therein. The separation roller 9 and the separation pad 10 oppose each other at the upper front end of the sheet supply tray 8 when the sheet supply tray 8 is installed in the body casing 2. The pickup roller 11 is disposed behind the separation roller 9. The sheets 3 are fed along the sheet supply path 13.

A sheet dust removing roller 14 and a pinch roller 15 opposing each other are disposed in front of and above the separation roller 9 in the sheet supply path 13. A pair of register rollers 16 is disposed above the sheet dust removing roller 14 and the pinch roller 15.

The image forming section 5 includes an exposure unit 17, a process unit 18, a transfer unit 19, and a fixing unit 20.

The exposure unit 17 is disposed at an upper portion of the body casing 2. The exposure unit 17 includes a support plate 21 extending in the front-rear and right-left directions above the process unit 18 placed in the installation position, and a casing 22 supported on the upper surface of the support plate 21. A laser beam emitting portion and a polygon mirror are disposed in the casing 22.

The exposure unit 17 emits laser beams from the laser beam emitting portion, with the laser beams corresponding to image data for each yellow, magenta, cyan, and black color. The laser beams are scanned by the polygon mirror. The laser beams pass through a window formed in the support plate 21 to irradiate surfaces of photosensitive drums 31 (described below).

The process unit 18 includes a drum unit 23, as an example of an image carrier unit, and four developing cartridges 24 for each color.

Figure 2:
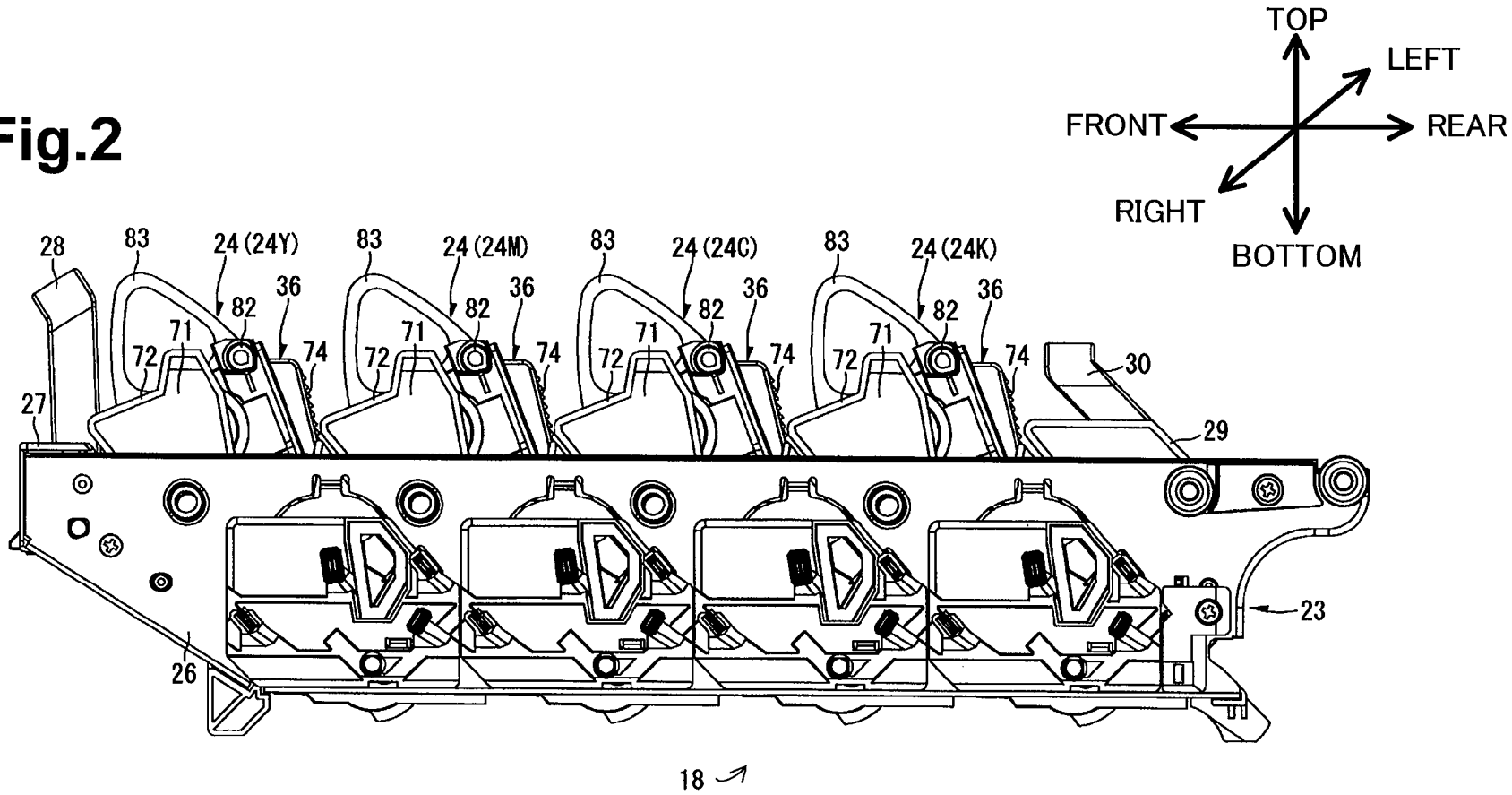
FIG. 2 is a right-side view of a process unit shown in FIG. 1.

Referring to FIGS. 1 and 2, the drum unit 23 will be described. The drum unit 23 includes four sub units 25, each corresponding to one color, a pair of side plates 26 sandwich the four drum units 25 from the right and left sides (FIG. 2 only showing right side plate 26), a front beam 27 disposed between the front ends of the side plates 26, a front holding portion 28 disposed at the front beam 27, a rear beam 29 disposed between the rear ends of the side plates 26, and a rear holding portion 30 disposed at the rear beam 29.

As shown in FIG. 1, the sub units 25 include a yellow sub unit 25Y, a magenta sub unit 25M, a cyan sub unit 25C and a black sub unit 25K that are arranged in this order from the front side along the front-rear direction with some distance between adjacent sub units 25.

Each sub unit 25 holds a photosensitive drum 31, as an example of an image carrier, a scorotron charger 32, and a cleaning brush 33.

The photosensitive drum 31 is of a cylindrical shape and is rotatable. The surface of the photosensitive drum 31 is uniformly and positively charged by the charger 32 during an image formation. The cleaning brush 33 is disposed to remove paper dust or fibers left on the photosensitive drum 31 after the image is transfer to the sheet 3. The cleaning brush 33 is disposed behind the photosensitive drum 31.

The four developing cartridges 24 are configured to be detachably mounted in the corresponding sub units 25 provided for each color, as shown in FIG. 1. More specifically, the developing cartridges 24 include a yellow developing cartridge 24Y detachably mountable in the yellow sub unit 25Y, a magenta developing cartridge 24M detachably mountable in the magenta sub unit 25M, a cyan developing cartridge 24C detachably mountable in the cyan sub unit 25C, and a black developing cartridge 24K detachably mountable in the black sub unit 25K.

Each developing cartridge 24 includes a box-shaped case 36 with an opening at its lower end. Each developing cartridge 24 further includes an agitator 37, a supply roller 38, a developing roller 39, as an example of a developer carrier, and a layer thickness regulating blade 40 that are disposed in the case 36.

Toner as a developer is contained in the case 36. More specifically, the yellow developing cartridge 24Y contains yellow toner, the magenta developing cartridge 24M contains magenta toner, the cyan developing cartridge 24C contains cyan toner, and the black developing cartridge 24K contains black toner. Each developing cartridge 24 contains, for example, positively chargeable non-magnetic single component polymerized toner.

The agitator 37 agitates the toner in the case 36. The supply roller 38 includes a metal supply roller shaft 41 rotatably supported by the case 36 and a conductive sponge roller 42 covering a peripheral surface of the supply roller shaft 41. The developing roller 39 includes a metal developing roller shaft 43 rotatably supported by the case 36 and a conductive rubber roller 44 covering a peripheral surface of the developing roller shaft 43. The layer thickness regulating blade 40 is supported by the case 36 at its end opposite to the free end of the blade 40.

The toner contained in the case 36 of each developing cartridge 24 is supplied due to its own weight to the supply roller 38 while being agitated by the agitator 37. The toner supplied to the supply roller 38 is then supplied to the developing roller 39 while the supply roller 38 is rotating. At this time, the toner is positively charged by friction between the developing roller 39 to which developing bias is applied and the supply roller 38. The toner supplied to the developing roller 39 passes between the blade 40 and the developing roller 39 while the developing roller 39 rotates. The toner is carried on the surface of the developing roller 39 as a thin layer whose thickness has been uniformly regulated.

In the sub unit 25, the surface of the photosensitive drum 31 is uniformly and positively charged by the corresponding charger 32 while the drum 31 is rotating. The positively-charged drum 31 surface is selectively exposed to the laser beam emitted from the exposure unit 17 at high speed, to form on the surface of the drum 31 an electrostatic latent image corresponding to an image to be formed on the sheet 3.

As the toner, which is carried on the developing roller 39 and is positively charged, is brought into confrontation with the corresponding photosensitive drum 31 by the rotation of the developing roller 39 while the drum 31 is rotated, the toner is supplied to the electrostatic latent image formed on the surface of the photosensitive drum 31. Thus, the electrostatic latent image on the drum 31 is made visible and a toner image of each color is formed on the relevant photosensitive drums 31.

The transfer unit 19 is disposed above the sheet supply section 4 and below the process unit 18 in the body casing 2, along the front-rear direction, as shown in FIG. 1. The transfer unit 19 includes a drive roller 46, a driven roller 47, a conveying belt 48, transfer rollers 49, and a cleaning unit 50.

The sheet 3 supplied from the sheet supply section 4 is fed from the front side to the rear side by the conveying belt 48 circulated by the drive roller 46 and the driven roller 47, so as to sequentially pass through transfer positions between the conveying belt 48 and the photosensitive drums 31. The color toner images carried on the photoconductive drums 31 are transferred onto the sheet 3 while the sheet 3 passes between the transfer positions. Thus, a color image is formed on the sheet 3.

More specifically, as the yellow toner image carried on the surface of the photoconductive drum 31 of the yellow sub unit 25Y is transferred on the sheet 3, the magenta toner image carried on the surface of the photoconductive drum 31 of the magenta process units 25M is then transferred on the sheet 3 having the yellow toner image transferred thereon. Similarly, the cyan and black toner images carried on the surfaces of the photoconductive drums 31 of the cyan and black process units 25C, 25K, respectively, are transferred on the sheet 3. Thus, each of the different colored images is laid on top of each other.

The fixing unit 20 is disposed behind the black sub unit 25K in the body casing 2 to face, in the front-rear direction, the transfer position between the photosensitive drum 31 and the conveying belt 48. The fixing unit 20 includes a heat roller 55 and a pressure roller 56.

The sheet 3 is fed to the fixing unit 20 where the color toner images transferred onto the sheet 3 are thermally fixed while the sheet 3 passes between the heat roller 55 and the pressure roller 56. Thus, a color image is formed on the sheet 3.

In the sheet ejection section 6, the sheet 3 is fed from the fixing unit 20 along a sheet ejection path 57 to a feed roller 59 and a pinch roller 60, and ejected by a pair of ejection rollers 61 onto a sheet ejection tray 58.

The case 36 of each developing cartridge 24 will be described in detail below.

Figure 3:
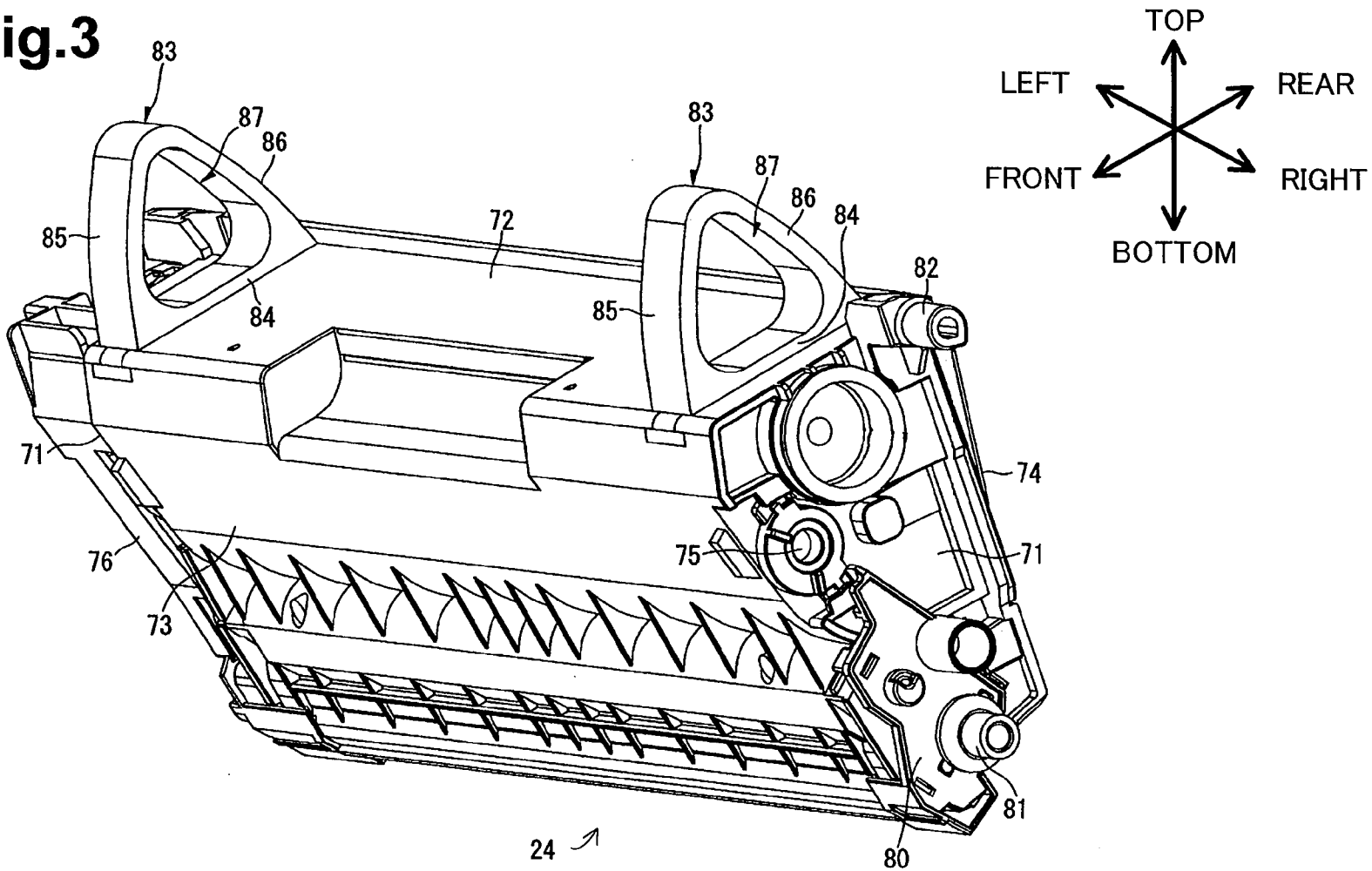
FIG. 3 is a perspective view of a developing cartridge viewed from the upper front right side.
Figure 4:
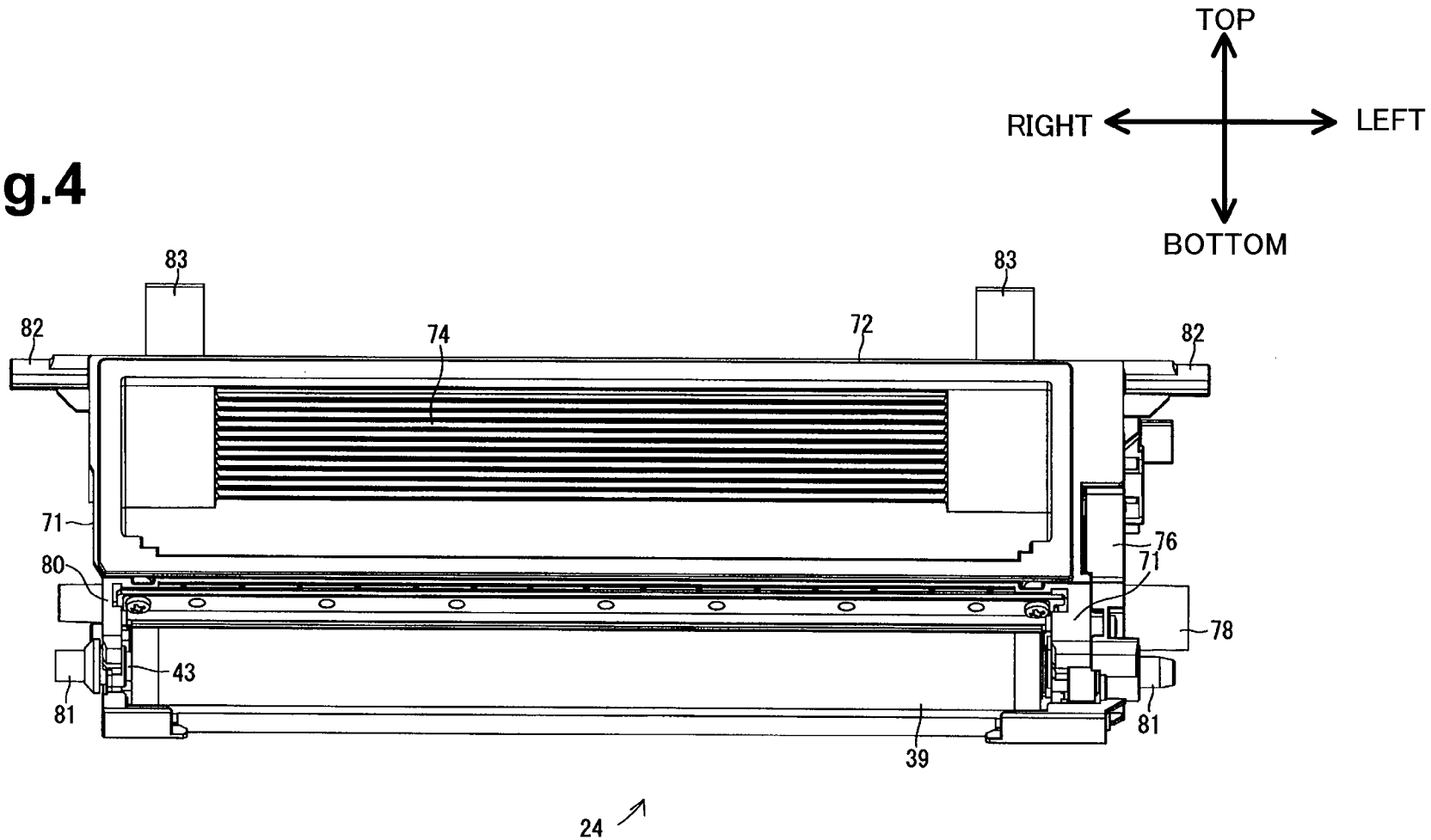
FIG. 4 is a rear-side view of the developing cartridge shown in FIG. 3.
Figure 5:
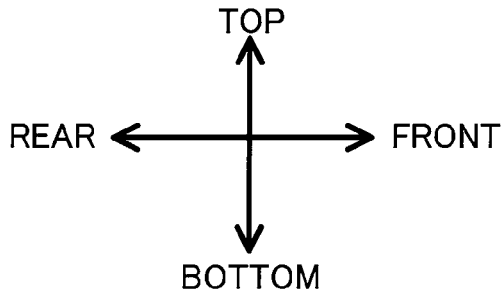
FIG. 5 is a left side view of the developing cartridge shown in FIG. 3.
Figure 5:
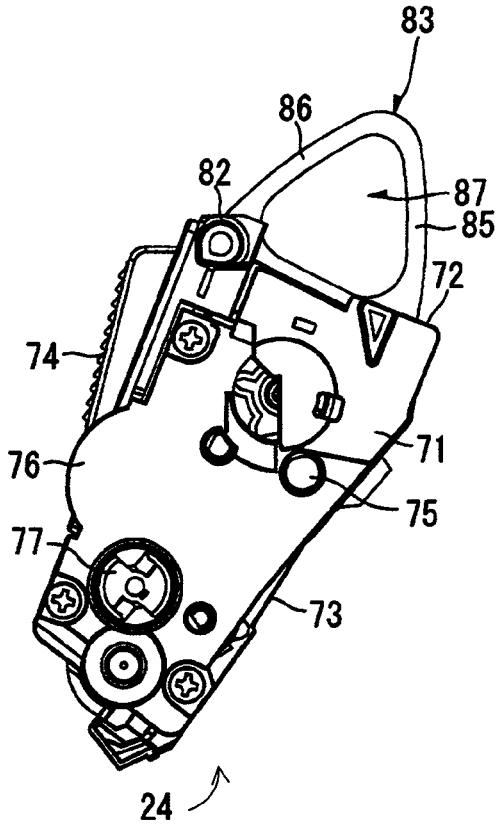

As shown in FIGS. 3-5, the case 36 may include a pair of sidewalls 71 facing each other in the left and right direction, a top wall 72 disposed between the sidewalls 71 at their top ends, a front wall 73 disposed between the sidewalls 71 at their front ends, and a rear wall 74 disposed between the sidewalls 71 at their rear ends. The sidewalls 71, the front wall 73, and the rear wall 74 define, at their bottom ends, an opening from which the developing roller 39 is exposed.

Each sidewall 71 has a window 75 for detecting the amount of toner stored in the case 36. The windows 75 are disposed opposite to each other in the left and right direction. The windows 75 allow light to pass therethrough along the left and right direction.

As shown in FIG. 5, the left sidewall 71 is provided with a gear mechanism (not shown) covered with a gear cover 76. The gear mechanism includes a driven coupling gear 77 and a gear train (not shown). Drive force input to the driven coupling gear 77 is transmitted via the gear train to the agitator 37, the supply roller 38, and the developing roller 39.

A bearing member 80 that rotatably supports the right end of the developing roller shaft 43 is disposed at a lower side of the right sidewall 71, as shown in FIGS. 3 and 4. The right end of the developing roller shaft 43 is rotatably inserted into a hole formed in the bearing member 80. The left end of the developing roller shaft 43 is rotatably inserted in a hole formed in the left sidewall 71. Thus, the developing roller shaft 43 is rotatably supported by the case 36. The left end and right end of the developing roller shaft 43 extend outward from the gear cover 76 and the bearing member 80, respectively. A part of the end of the shaft 43 extending from the gear cover 76 or the bearing member 80 is covered by a collar member 81, as shown in FIG. 4.

As shown in FIGS. 3-5, a separation projection 82 is provided so as to extend outwardly in the left and right direction from an upper end of each sidewall 71. The separation projection 82 is of a substantially cylindrical shape.

An elastic handle 83 is disposed at right and left ends of the top wall 72. The handle 83 may be formed of an elastic material, such as rubber. The handle 83 may have a substantially triangular shape in a side view extending upward. In other examples, the handle 83 may have other shapes including ovals, circles, multi-sided shapes, combinations thereof, and the like.

As shown in FIG. 3, the handle 83 is provided substantially across the width of the top wall 72 in the front-rear direction. The handle 83 includes a fixed portion 84 that is fixed on the top wall 72, a front portion 85 that extends from the front end of the fixed portion 84 toward an upward and rearward direction, and a rear portion 86 that extends from the rear end of the fixed portion 84 toward an upward and frontward direction. Upper ends of the front portion 85 and the rear portion 86 are connected. The fixed portion 84, the front portion 85 and the rear portion 86 define a substantially triangular opening 87 in side view. The opening 87 passes through in the left and right direction, which is a thickness direction of the handle 83.

When a user installs the developing cartridge 24 in the drum unit 23, the user holds the handles 83 with his/her hands. The developing cartridge 24 is inserted into the corresponding sub unit 25 from above, such that the developing roller 39 is brought into contact with an upper front portion of the corresponding photosensitive drum 31. When a user takes the developing cartridge 24 out of the drum unit 23, the user holds the handles 83 with his/her hands and pulls the developing cartridge 24 upwardly.

Pressing of the developing roller 39 against the corresponding photosensitive drum 31 will be described with reference to FIGS. 6-8.

To place the process unit 18 in the installation position in the body casing 2, the process unit 18 is slidably inserted along the front-rear direction from the front side of the body casing 2 toward the rear side when the front cover 7 is open.

As shown in FIG. 6, when the process unit 18 is in the withdrawal position, the handles 83 of the developing cartridges 24 do not contact the bottom surface of the support plate 21 of the exposure unit 17 disposed in the body casing 2.

When the process unit 18 is further inserted inward/rearward, the handles 83 of the developing cartridges 24 contact, sequentially from the rearmost black developing cartridge 24K, the bottom surface of the support plate 21. The handles 83 elastically deform in the vertical direction between the bottom surface of the support plate 21 and the top wall 72 of the case 36, as shown in FIG. 7.

When the process unit 18 is placed in the installation position, the handles 83 of all developing cartridges 24 contact the bottom surface of the support plate 21 and elastically deform in the vertical direction between the bottom surface of the support plate 21 and the top wall 72 of the case 36, as shown in FIG. 8.

When the handles 83 are elastically deformed, its restoring force is applied to the bottom surface of the support plate 21. With the force acting on the support plate 21, the case 36 of the developing cartridge 24 is urged downward. Thus, the developing roller 39 can be pressed against the corresponding photosensitive drum 31.

A contact/separation mechanism 91 for making the developing roller 39 contact to or separate from the corresponding photosensitive drum 31 will be described with reference to FIGS. 9-13.

Figure 9:
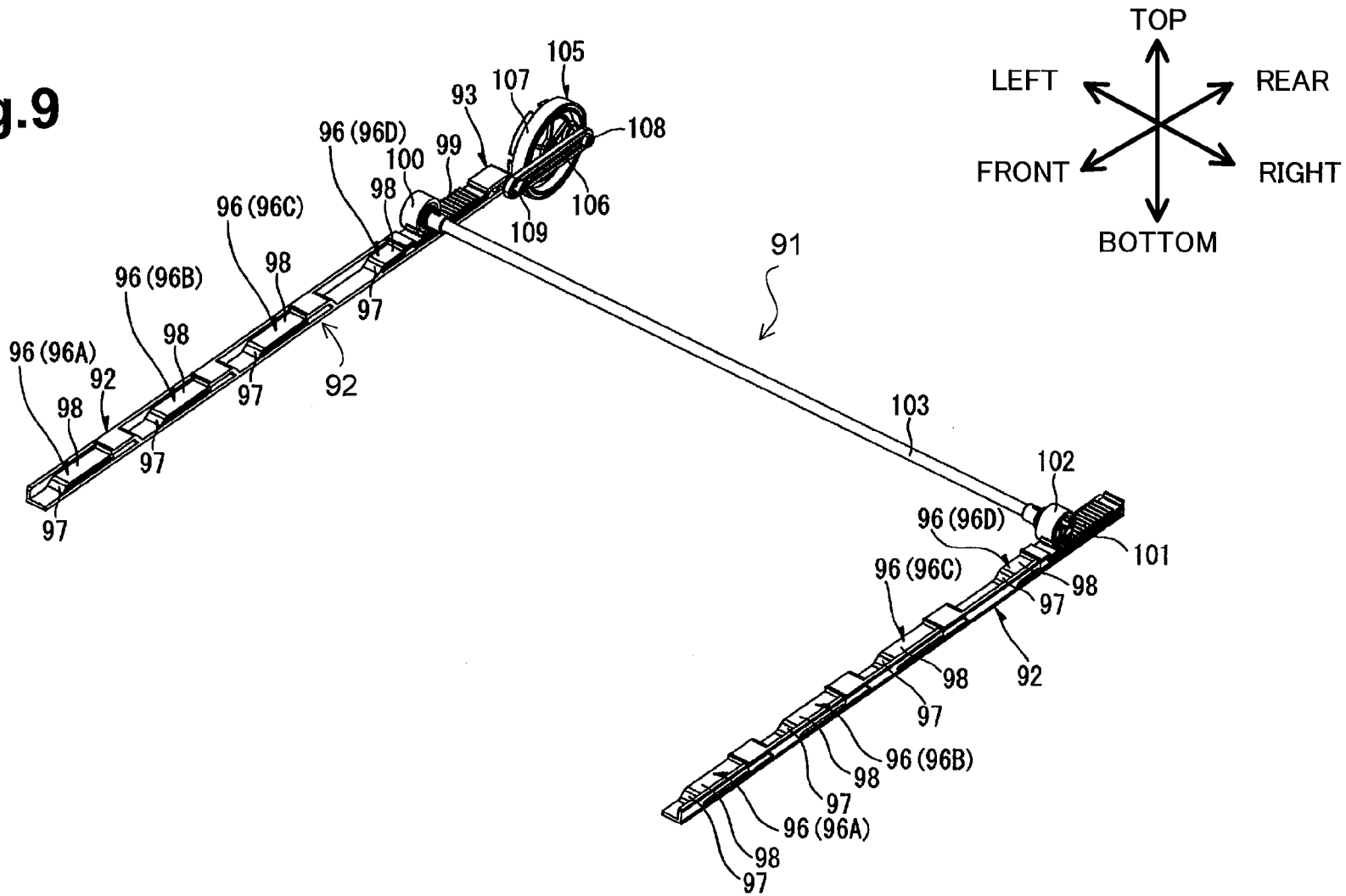
FIG. 9 is a perspective view of a contact/separation mechanism provided in the color laser printer shown in FIG. 1 viewed from an upper front right side.

As shown in FIG. 9, the contact/separation mechanism 91 of the color laser printer 1 may include a pair of linear cam members 92 and a synchronous moving mechanism 93. The linear cam members 92 are disposed so as to interpose therebetween the process unit 18 placed in the installation position. The linear cam members 92 are configured to move linearly in the front-rear direction. The synchronous moving mechanism 93 is configured to linearly move the linear cam members 92 in synchronization with each other.

Figure 10:
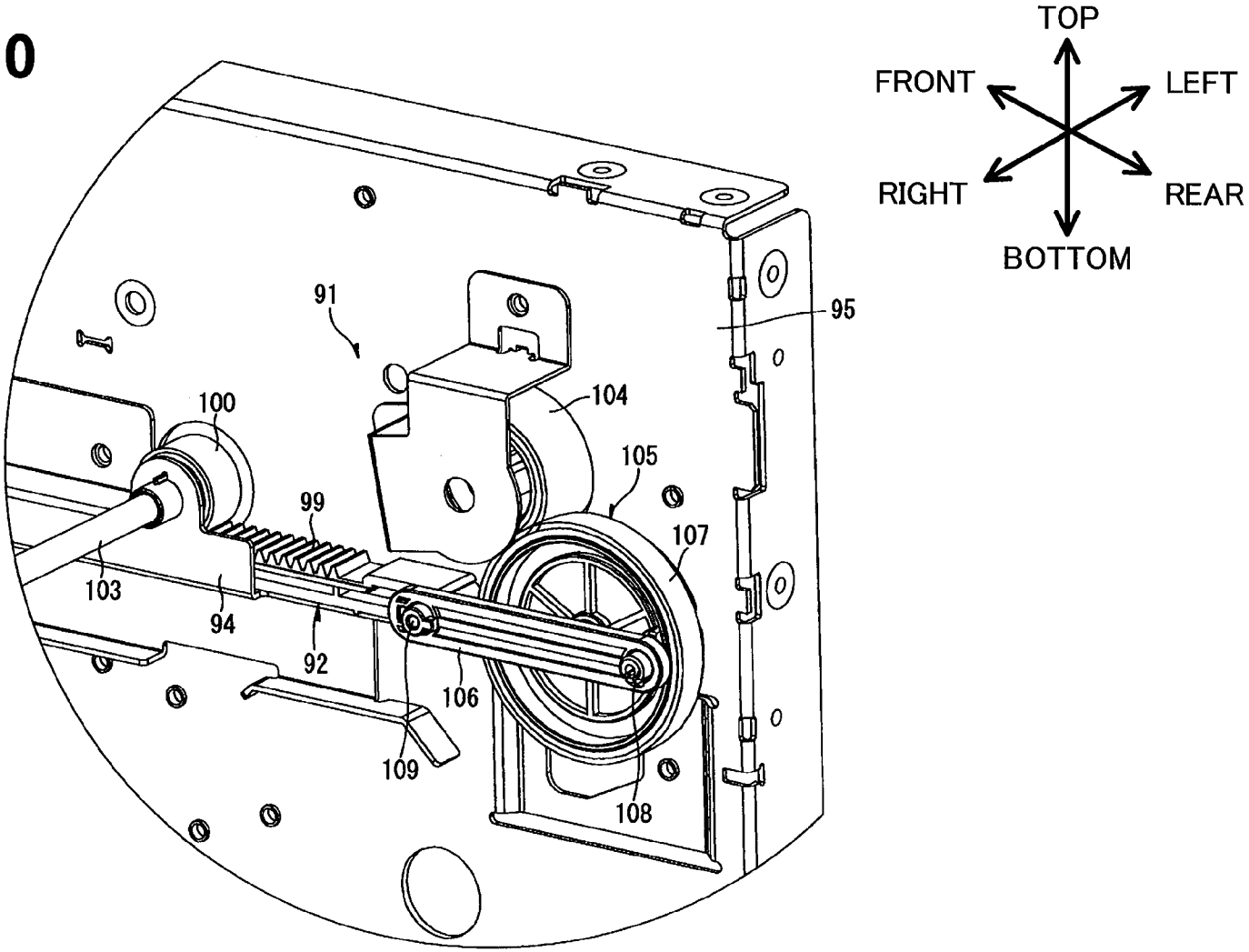
FIG. 10 is a perspective view of a rear end of a left contact/separation member shown in FIG. 9, viewed from a rear right side.

Each linear cam member 92 is of a substantially plate shape elongated in the front-rear direction. As shown in FIG. 10, each linear cam member 92 is slidably held by a substantially L-shaped holder 94 in a cross section that extends in the front-rear direction. Each holder 94 (only left holder 94 shown in FIG. 10) is fixed on an inner surface of one of a pair of frames 95 (only left frame 95 shown in FIG. 10). The frames 95 are disposed within the body casing 2 opposite to each other in the left and right direction. The linear cam members 92 contact protrusions 82 (FIG. 4), which extend from the sidewalls 71, from underneath when the process unit 18 is placed in the installation position.

As shown in FIG. 9, each linear cam member 92 includes cam portions 96 of a substantially trapezoidal shape in a side view. Four cam portions 96 are provided on an upper surface of each linear cam member 92 in association with the protrusions 82. Each cam portion 96 includes a slide surface 97 provided at an angle from the lower front side to the upper rear side, and a flat separation surface 98 that extends rearward from a rear end of the slide surface 97.

Figure 11:
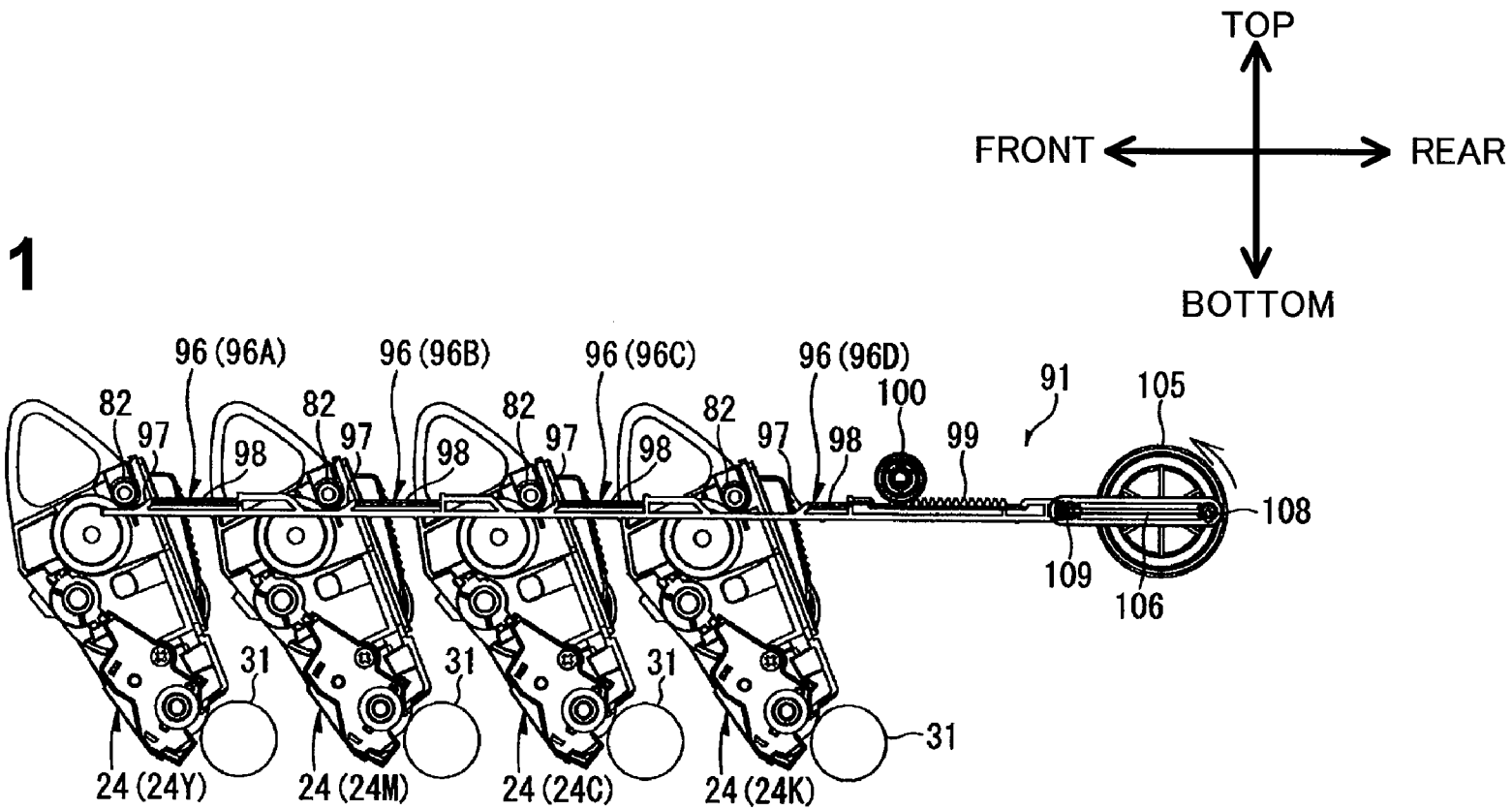
FIG. 11 is a right side view of the developing cartridges shown in FIG. 3 and the contact/separation member shown in FIG. 9, illustrating four developing cartridges are pressed against corresponding photosensitive drums.
Figure 12:
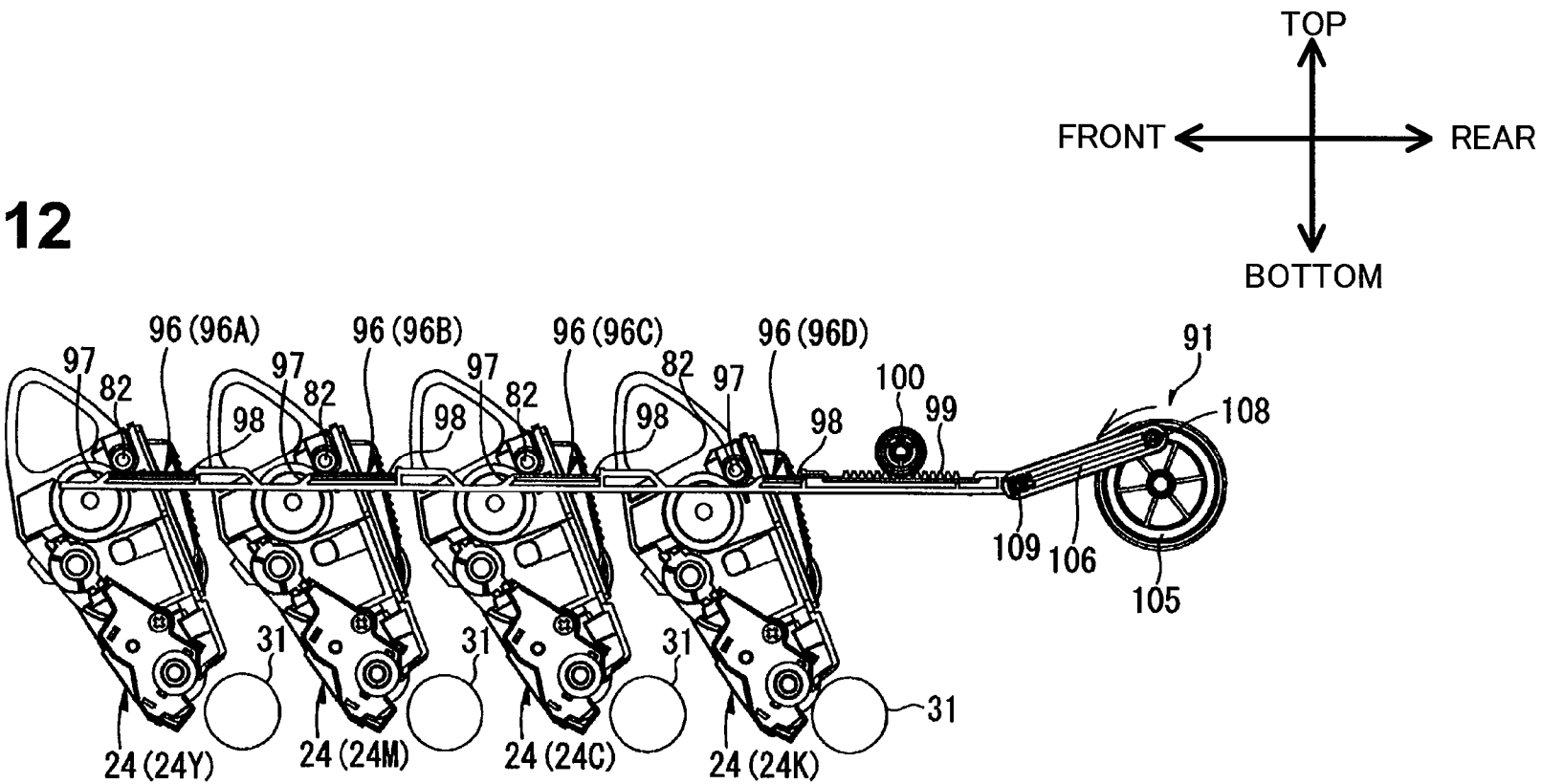
FIG. 12 is a right side view of the developing cartridges shown in FIG. 3 and the contact/separation member shown in FIG. 9, illustrating three developing cartridges being separated from the corresponding photosensitive drums and one developing cartridge as pressed against the corresponding photosensitive drum.
Figure 13:
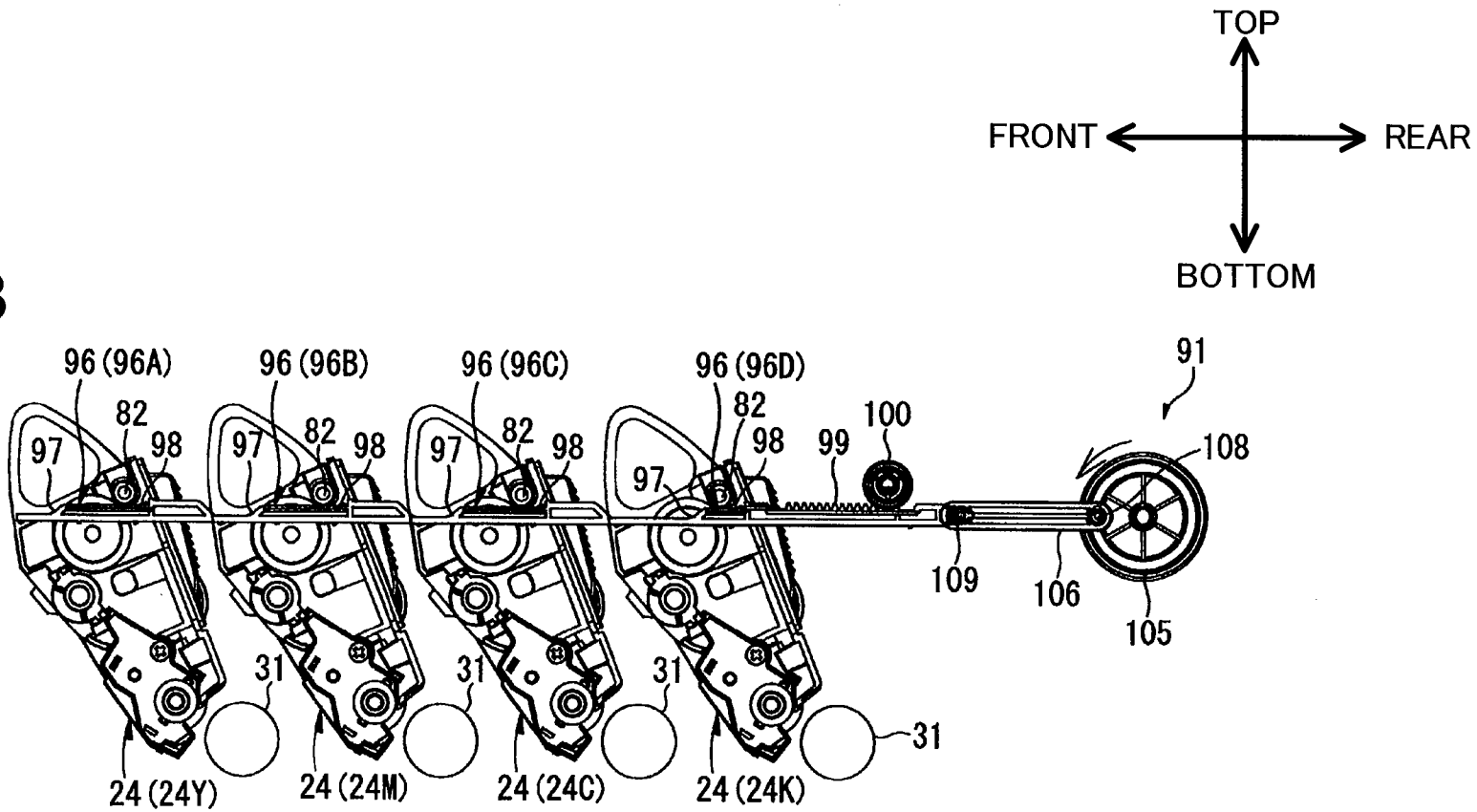
FIG. 13 is a right side view of the developing cartridges shown in FIG. 3 and the contact/separation member shown in FIG. 9, illustrating four developing cartridges being separated from the corresponding photosensitive drums.

In association with the positions of the linear cam members 92, the four cam portions 96 take states as shown in FIGS. 11-13, i.e., a state where all protrusions 82 are positioned in the front of the corresponding cam portions 96 as shown in FIG. 11; a state where the protrusion 82 of the black developing cartridge 24K only is positioned in the front of the corresponding cam portion 96 and other protrusions 82 are disposed on the corresponding cam portions 96 as shown in FIG. 12; and a state where all protrusions 82 are disposed on the corresponding cam portions 96 as shown in FIG. 13.

More specifically, the first three cam portions 96A, 96B, 96C from the front side are formed into the substantially same shape and are disposed equidistantly. The distance between the last (rearmost) cam portion 96D and the third cam portion 96C is greater than a distance between each of the other three cam portions 96A, 96B, 96C. The rearmost cam portion 96D has the separation surface 98 shorter that that of other three cam portions 96A, 96B, 96C in the front-rear direction.

The synchronous moving mechanism 93 is configured to transmit drive force from the left linear cam member 92 to the right linear cam member 92.

More specifically, as shown in FIGS. 9 and 10, the synchronous moving mechanism 93 includes a left rack gear 99, a left pinion gear 100, a right rack gear 101, a right pinion gear 102, a connecting shaft 103, a transmission gear 104, a crank gear 105, and a conversion member 106. The left rack gear 99 is formed on an upper rear surface of the left linear cam member 92. The left pinion gear 100 is configured to engage with the left rack gear 99. The right rack gear 101 is formed on an upper rear surface of the right linear cam member 92. The right pinion gear 102 is configured to engage with the right rack gear 101. The connecting shaft 103 mounts the left pinion gear 100 and the right pinion gear 102 on each end thereof such that the left pinion gear 100 and the right pinion gear 102 do not rotate relative to the shaft 103. The transmission gear 104 is fixed on the left frame 95 and is configured to transmit drive force from a motor (not shown). The crank gear 105 is rotated in one direction (e.g., in the counterclockwise direction in FIG. 10) with the rotating force of the transmission gear 104. The conversion member 106 is configured to convert the rotation of the crank gear 105 into linear movement for the left linear cam member 92.

The left pinion gear 100 and the right pinion gear 102 engage with the left rack gear 99 and the right rack gear 101, respectively, at their front ends when the linear cam members 92 are moved to the rearmost positions, as shown in FIG. 11. When the linear cam members 92 are moved to the foremost positions as shown in FIG. 13, the left pinion gear 100 and the right pinion gear 102 engage with the left rack gear 99 and the right rack gear 101, respectively, at their rear ends.

The connecting shaft 103 is disposed between the holders 94, and rotatably supported by the holders 94, as shown in FIG. 10.

The crank gear 105 is rotatably supported by a central shaft, which extends in the left and right direction and is supported by the frame 95. A gear 107 that engages with the transmission gear 104 is formed on the perimeter of the crank gear 105. The crank gear 105 is provided with a rear-side protruding shaft 108 that protrudes toward the right side.

The rearmost end of the left linear cam member 92 is provided with a front-side protruding shaft 109 that protrudes toward the right side. When the linear cam member 92 is in the rearmost position or the foremost position, as shown in FIGS. 11 and 13, the front-side protruding shaft 109 faces the rear-side protruding shaft 108 in the front-rear direction in parallel with each other.

The conversion member 106 is disposed between the rear-side protruding shaft 108 and the front-side protruding shaft 109, such that an end of the conversion member 106 moves along a movement path of the rear-side protruding shaft 108 when the crank gear 105 is rotated.

As shown in FIG. 11, when the linear cam members 92 are moved to the rearmost position, each protrusion 82 of the developing cartridges 24 is placed in front of the corresponding cam portion 96, and contacts an upper surface of the linear cam members 92. The developing roller 39 of each developing cartridge 24 is pressed against the corresponding photosensitive drum 31 with the elastic force (restoring force) of the handles 83.

As the transmission gear 104 is rotated by drive force from the motor (not shown) in the state as shown in FIG. 11, the crank gear 105 is rotated counterclockwise in FIG. 11. Accordingly, the rear-side protruding shaft 108 moves frontward, and the left linear cam member 92 moves frontward. With the movement of the left linear cam member 92, the left pinion gear 100 rotates clockwise in FIG. 11, and the rotation of the left pinion gear 100 is transmitted to the right pinion gear 102 via the connecting shaft 103. The right pinion gear 102 rotates in the same direction as the left pinion gear 100, and consequently, the right linear cam member 92 moves frontward.

As shown in FIG. 12, when the crank gear 105 rotates approximately 90 degrees from the state shown in FIG. 11, the protrusions 82 of the yellow, magenta and cyan developing cartridges 24Y, 24M, 24C slide on the sliding surfaces 97 of the corresponding cam portions 96 and are raised on the separation surfaces 98 of the corresponding cam portions 96. The protrusions 82 of the black developing cartridge 24K are positioned in the front of the corresponding cam portions 96. Thus, the yellow developing cartridge 24Y, the magenta developing cartridge 24M, and the cyan developing cartridge 24C are moved upward, and their developing rollers 39 separate from the corresponding photosensitive drums 31. Only the developing roller 39 of the black developing cartridge 24K is in contact with the corresponding photosensitive drum 31.

As shown in FIG. 13, when the crank gear 105 is rotated counterclockwise approximately 180 degrees from the state shown in FIG. 11, by driving the motor, the linear cam members 92 are moved to the foremost position, the protrusions 82 of all developing cartridges 24 are raised on the separation surfaces 98 of the corresponding cam portions 96. Thus, all the developing cartridges 24 are moved up and the developing rollers 39 of the developing cartridges 24 separate from the corresponding photosensitive drums 31.

When the motor is further driven to rotate the crank gear 105 counterclockwise in FIG. 13, the rear-side protruding shaft 108 is moved rearward and accordingly the pair of linear cam members 92 is moved rearward. When the crank gear 105 is rotated 180 degrees from the state shown in FIG. 13, all the developing cartridges 24 are placed in the state as shown in FIG. 11 where the developing rollers 39 are pressed against the corresponding drums 31.

As described above, the case 36 of each developing cartridge 24 has the handles 83. A user can install or remove the developing cartridge 24 in or from the drum unit 23 (the corresponding sub unit 25) while holding the handles 83. At least some parts of the handles 83 are elastically deformable. For instance, all of the handles 83 may be elastically deformable or less than all of the handles 83 may be elastically deformable. Therefore, as being deformable, even when a space between the support plate 21 of the exposure unit 17 and the process unit 18 placed in the installation position is small, the handles 83 may be fitted, due to their elastic deformation in the small space. Thus, the developing cartridges 24 may be readily installed in or removed from the drum unit 23 with the handles 83. Further, the handles 83 may not hinder the installation or removal of the process unit 18 in or from the body casing 2.

Before insertion into color laser printer 1, the handles 83 may be in an undeformed state. In FIGS. 11-13, the handles 83 are shown in one or more deformed states. For instance, in FIG. 11, where all developing cartridges 24 are supported by the drum unit 23 that results in the developing rollers 39 being pressed against the photosensitive drums 31, the handles 83 may be in a first deformation state. In FIG. 12, one of the handles 83 is in the first deformation state while the other handles 83 are in a second deformation state. In FIG. 13, where all developing cartridges 24 are separated from the drum unit 23, the handles 83 may be in the second deformation state. Although not shown, it is appreciated that additional states of deformation and no deformation may exist when the developing cartridges 24 are inserted into the color laser printer 1. For instance, the support plate 21 may possibly be raised and lowered inside the color laser printer 1 to deform and not to deform the handles 83.

When the process unit 18 is moved from the withdrawal position to the installation position, the handles 83 elastically deform between the top wall 72 of the developing cartridge 24 and the support plate 21 of the exposure unit 17. With the elastic force (restoring force) of the handles 38 applied to the bottom surface of the support plate 21, the developing roller 39 may be pressed against the corresponding photosensitive drum 31. Thus, additional device to press the developing roller 39 against the corresponding photosensitive drum 31 may not be required, reducing costs and the number of components to be used.

Every time the developing cartridge 24 is replaced with new one, the handles 83 may be also replaced with new ones. Thus, the handles 83 may not be continuously used in a condition where the elasticity of the handles 83 is reduced. Thus, favorable pressing of the developing roller 39 against the corresponding photosensitive drum 31 may be continued. Accordingly, development failures may be reduced that are attributable to shortage of toner supply from the developing roller 39 to the photosensitive drum 31 due to the reduced pressing force of the developing roller 39. Thus, a quality image may be produced.

For example, when specifications of the toner or the developing roller 39 are changed, the handles 83 may be formed of one or more materials having elasticity that meets the specification changes. Thus, pressing force of the developing roller 39 against the corresponding photosensitive drum 31 may be properly controlled to ensure the appropriate toner supply from the developing roller 39 to the corresponding photosensitive drum 31. Accordingly, an electrostatic latent image formed on the photosensitive drum 31 may be made visible or developed favorably, leading to quality image formation.

The handle 83 is provided at each end, with respect to the left and right direction, of the case 36 of the developing cartridge 24. While holding the handles 83, a user may stably handle the developing cartridge 24. Each end of the case 36 where the handle 83 is disposed corresponds to an end of the developing roller 39 in its axial direction. Therefore, when the process unit 18 in which the developing cartridges 24 are installed in the drum unit 23 is placed in the installation position, the developing roller 39 may be pressed against the corresponding photosensitive drum 31 in a well-balanced manner in the axial direction of the roller 39 through the case 36, with the elastic force of the handles 83 applied to the bottom surface of the support plate 21. Thus, toner may be supplied from the developing roller 39 to the corresponding photosensitive drum 31 uniformly in the axial direction of the drum 31. Consequently, an electrostatic latent image formed on the photosensitive drum 31 may be made visible or developed favorably.

The support plate 21 of the exposure unit 17 has the window, as described above, that passes laser beams therethrough to irradiate the photosensitive drum 31 with the laser beams. The length of the window in the axial direction of the developing roller 39 (left and right direction) is shorter than the length of the rubber roller 44 of the developing roller 39 and the length of the case 36. Because the handle 83 is disposed on each end of the case 36 in the left and right direction, the handles 83 may not get caught in the window when the process unit 18 is moved between the installation position and the withdrawal position. Consequently, the process unit 18 may be smoothly moved.

The handle 83 has the opening 87 that passes through in its thickness direction, so that the handle 83 may readily elastically deform. Thus, the handles 83 may not interfere with the installation of the process unit 18 in the body casing 2.

The handle 83 extends along an insertion/withdrawal direction of the process unit 18 into/from the body casing 2.

The opening 87 is provided in a direction perpendicular to the insertion/withdrawal direction. When the handles 83 contact the bottom surface of the support plate 21 while the process unit 18 is moved in the insertion/withdrawal direction, the handles 83 may be elastically and reliably deformed.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus, comprising:

a casing;

an image carrier unit configured to move in a first direction between a first position and a second position in the casing, the image carrier unit configured to hold a plurality of image carriers, each image carrier configured to carry an electrostatic latent image thereon;

a plurality of developing cartridges configured to be removably mounted in the image carrier unit; and an exposure unit disposed in the casing;

wherein each developing cartridge includes:

a developer carrier configured to supply developer to the image carrier;

a case configured to contain the developer, the case having a support portion for supporting the developer carrier at one side of the case; and a handle made of elastic material and connected to at least an opposite side of the case, the handle being configured to directly contact the exposure unit and to deform when the image carrier unit is in the first position.

2. The image forming apparatus according to claim 1, wherein the handle of at least one developing cartridge is out of contact with the exposure unit when the image carrier unit is in the second position.

3. The image forming apparatus according to claim 1, wherein, when the image carrier unit is in the first position, the handle urges the developer carrier toward the image carrier.

4. The image forming apparatus according to claim 3, wherein the developer carrier extends in a second direction perpendicular to the first direction, and the handle is disposed at each end of the case in the second direction.

5. The image forming apparatus according to claim 1, further comprising an opening extending through the handle.

6. The image forming apparatus according to claim 5, wherein the handle extends along the first direction and the opening faces in the second direction.

7. The image forming apparatus according to claim 1, wherein the handle forms an opening with the case.

8. The image forming apparatus according to claim 1, wherein at least part of the handle is deformable.

9. The image forming apparatus according to claim 1, wherein the handle only contacts the top side of the case.

10. A developing cartridge configured to be installed in an image forming apparatus, comprising:

a developer carrier configured to supply developer to an image carrier of the image forming apparatus;

a case configured to contain the developer, the case having a support portion for supporting the developer carrier at one side of the case; and a handle made of elastic material and disposed at least on an opposite side of the case, the handle being configured to deform from directly contacting an exposure unit in the image forming apparatus when the developing cartridge is installed in the image forming apparatus such that the developing cartridge moves toward the image carrier and presses the developer carrier against the image carrier.

11. The developing cartridge according to claim 10, wherein the developing cartridge is removably mounted on an image carrier unit that is configured to move along a first direction between a first position and a second position with respect to the image forming apparatus and when the image carrier unit is in the first position, the handle urging the developer carrier toward the image carrier.

12. The developing cartridge according to claim 10, wherein further comprising an opening extending through the handle.

13. The developing cartridge according to claim 12, wherein the handle extends along the first direction and the opening faces in a second direction perpendicular to the first direction.

14. The developing cartridge according to claim 13, wherein the developer carrier extends in the second direction and the handle is disposed at each end of the case in the second direction.

15. The developing cartridge according to claim 10, wherein at least part of the handle is deformable.

16. The developing cartridge according to claim 10, wherein the handle forms an opening with the case.

17. A method for pressing and separating a developer carrier of a developing cartridge from an image carrier in an image forming apparatus comprising:

deforming a deformable handle of the developing cartridge from an undeformed state to a first deformed state as the handle directly contacts an exposure unit of the image forming apparatus upon insertion of the developing cartridge into the image forming apparatus, the deformation resulting in pressing the developer carrier of the developing cartridge against the image carrier;

separating the developer carrier from the image carrier by lifting the developing cartridge away from the image carrier, the deformable handle continuing to be deformed in at least in the first deformed state.

18. The method according to claim 17, wherein separating the developer carrier results in a second deformed state, where the deformation of the handle of the developing cartridge is greater in the second deformed state than in the first deformed state.

19. The method according to claim 17, wherein the lifting of the developing cartridge includes engaging a separation mechanism that forces a protrusion of the developing cartridge in a direction away from the image carrier.

20. The method according to claim 17, the image forming apparatus including at least three additional developing cartridges, the separating the developer carrier further comprising:

separating developer carriers of the developing cartridge and a second and a third of the three additional developing cartridges, where a developer carrier of a third of the three additional developing cartridges remains in contact with the image carrier.

* * * * *